US008294530B2

(12) United States Patent
Van Swearingen et al.

(10) Patent No.: US 8,294,530 B2
(45) Date of Patent: Oct. 23, 2012

(54) PCB MOUNTED DIRECTIONAL COUPLER ASSEMBLY

(75) Inventors: Kendrick Van Swearingen, Woodridge, IL (US); Frank A. Harwath, Naperville, IL (US); Robert K Bell, Forest, VA (US)

(73) Assignee: Andrew LLC, Hickory, NC (US)

( * ) Notice: Subject to any disclaimer, the term of this patent is extended or adjusted under 35 U.S.C. 154(b) by 355 days.

(21) Appl. No.: 12/746,762

(22) PCT Filed: Dec. 29, 2008

(86) PCT No.: PCT/US2008/088401

§ 371 (c)(1),
(2), (4) Date: Jun. 7, 2010

(87) PCT Pub. No.: WO2009/086498

PCT Pub. Date: Jul. 9, 2009

(65) Prior Publication Data

US 2010/0265005 A1 Oct. 21, 2010

Related U.S. Application Data

(60) Provisional application No. 61/017,647, filed on Dec. 29, 2007.

(51) Int. Cl.
*H01P 5/18* (2006.01)
*H01P 5/00* (2006.01)

(52) U.S. Cl. ..... 333/24 R; 333/113

(58) Field of Classification Search ..... 333/109, 333/116, 24 R, 113

See application file for complete search history.

(56) References Cited

U.S. PATENT DOCUMENTS

| | | | |
|---|---|---|---|
| 2,562,281 | A | 7/1951 | Mumford |
| 2,606,974 | A | 8/1952 | Wheeler |
| 3,113,277 | A | 12/1963 | Casper et al. |
| 4,080,566 | A | 3/1978 | Mecklenburg |
| 5,382,932 | A | 1/1995 | Monti |
| 5,926,076 | A | 7/1999 | Johnson et al. |
| 6,066,994 | A | 5/2000 | Shepherd et al. |
| 6,312,281 | B1 | 11/2001 | Rodriguez |
| 6,660,939 | B1 | 12/2003 | Gunnels |
| 7,002,433 | B2 | 2/2006 | Antkowiak et al. |
| 7,183,876 | B2 | 2/2007 | Fallon et al. |
| 7,234,948 | B2 | 6/2007 | Kim et al. |
| 7,278,888 | B2 | 10/2007 | Kim et al. |
| 7,429,903 | B2 | 9/2008 | Antkowiak |
| 2004/0127103 | A1 | 7/2004 | Kim et al. |
| 2007/0222539 | A1 | 9/2007 | Antkowiak |

FOREIGN PATENT DOCUMENTS

WO 2005/093896 10/2005

OTHER PUBLICATIONS

International Preliminary Report on Patentability for counterpart application No. PCT/US2008/088401. Issued on Jul. 8, 2010.

*Primary Examiner* — Dean O Takaoka
(74) *Attorney, Agent, or Firm* — Babcock IP, PLLC

(57) ABSTRACT

A coupler assembly includes a monolithic body (5) with a bore (11) along a longitudinal axis. A coupler PCB chamber (7) with at least one coupler slot(s> (9) communicates between the PCB chamber and the bore. A coupler printed circuit board (15) is seated in the coupler PCB chamber. At least two couplers (17) are mounted upon the printed circuit board aligned generally parallel with the at least one coupler slot(s). A first side of each coupler may be coupled to a terminating load and a second side of each coupler may be coupled to a connection interface.

20 Claims, 10 Drawing Sheets

PCB MOUNTED DIRECTIONAL COUPLER ASSEMBLY

CROSS REFERENCE TO RELATED APPLICATIONS

This application claims the benefit of U.S. Provisional Patent Application No. 61/017,647, "PCB Mounted Dual Directional Coupler", by Kendrick Van Swearingen, Robert Bell and Frank Harwath, filed Dec. 29, 2007 and hereby incorporated by reference in the entirety.

BACKGROUND

Directional couplers may be used to monitor signal quality/strength and/or for splitting off a low percentage of the signal present in a transmission line such as a coaxial cable. A dual directional coupler may be used to detect simultaneous forward and reflected power levels, for example, to monitor the Voltage Standing Wave Ratio (VSWR) of a communication system.

Prior dual directional couplers, for example as shown in FIGS. 19 and 20, typically comprise a body comprised of two halves that mate together with a cylindrical bore formed between the two halves. The bore sidewall surfaces form an outer conductor and an inner conductor is supported coaxially within the bore. Connection interfaces at each end of the bore allow the directional coupler to be inserted in-line with a coaxial cable and/or the coaxial connection interfaces of other RF components or equipment. During manufacture, the two halves body configuration requires multiple separate workpiece setup and machining operations, including precision machining of the planar mating surfaces of each half, grinding of bore and coupler grooves and then assembly of the halves together prior to cutting of threads at the bore and coupler ports. Also, the mating seam between the two halves creates an opportunity for eventual failure of the selected environmental seal solution.

The alignment precision of coupling elements arranged coaxially within coupling slots open to the bore is a significant factor of directional coupler electrical performance. Uniformly isolated from the body and supported only at the coupler ports at the periphery of the body, the coupling elements must be dimensioned with enough rigidity to withstand expected vibration and impact shock levels. The coupler elements are typically brazed or soldered together from multiple portions, a manufacturing operation requiring a skilled operator. Manufacture and installation of the coupler elements to specification represents a significant quality control issue during coupler manufacture. Tolerance variances occurring across each of the multiple elements of the body and coupler accumulate, often requiring time-consuming tuning of individual units to meet design specifications.

Therefore, it is an object of the invention to provide an apparatus that overcomes deficiencies in the prior art.

BRIEF DESCRIPTION OF THE DRAWINGS

The accompanying drawings, which are incorporated in and constitute a part of this specification, illustrate embodiments of the invention and, together with the general and detailed descriptions of the invention appearing herein, serve to explain the principles of the invention.

DETAILED DESCRIPTION

The inventor has recognized that the prior directional couplers incorporate an excessive number of discrete components and required manufacturing operations. A directional coupler assembly according to the present invention presents a significant decrease in size, weight, materials and required manufacturing steps. Further, numerous prior quality control issues are eliminated by design according to the present invention.

Figure 1:
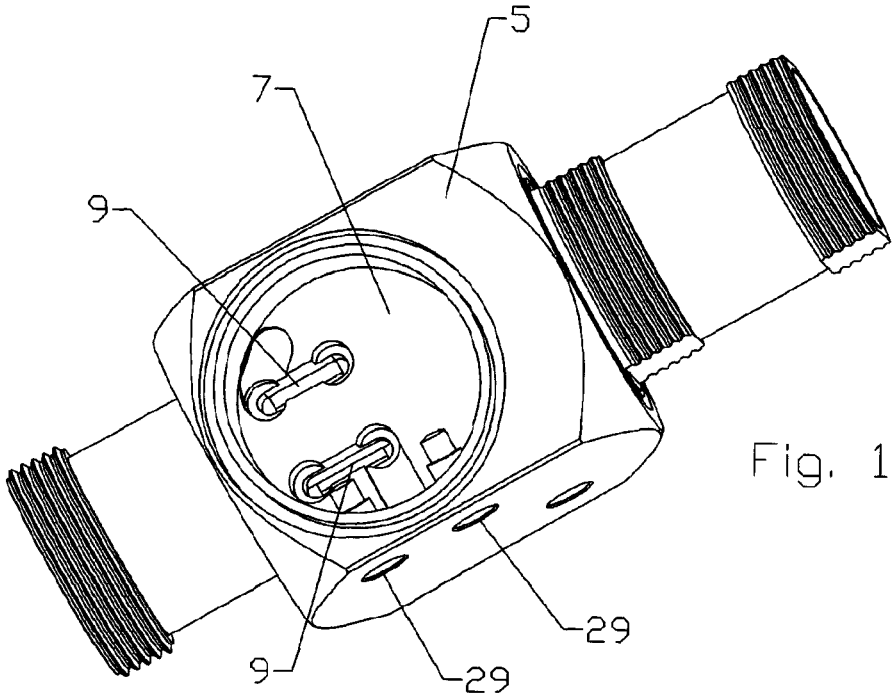
FIG. 1 is a schematic isometric top external view of a monolithic body according to a first exemplary embodiment.
Figure 2:
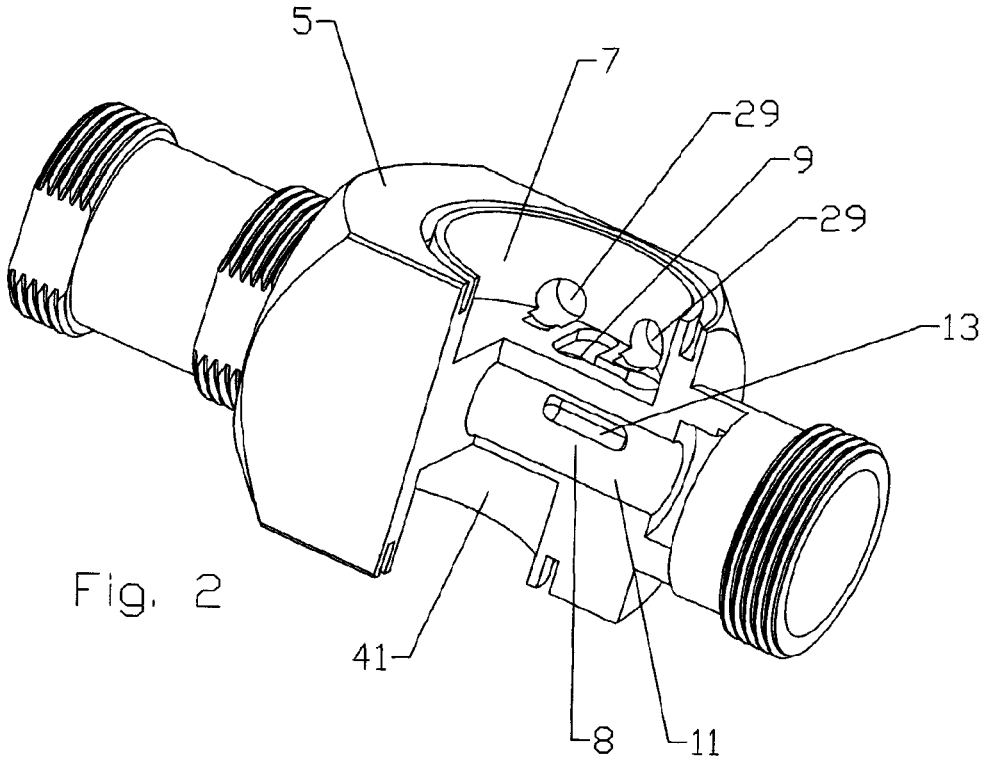
FIG. 2 is a schematic isometric partial cut-away side view of the monolithic body of FIG. 1.

As best shown in FIGS. 1 and 2, a first exemplary embodiment of a coupler assembly 1 according to the invention has a monolithic body 5. A monolithic body 5 eliminates the sealing issue between the prior two halves and presents significant manufacturing efficiencies when multi-axis, multiple spindle computer numerical control machining cells are applied to prepare the body 5 from a single piece of stock material or pre-molding, requiring only a single set-up mounting procedure per body 5 and/or enabling continuous machining efficiencies via configuring the stock material in bar or rod form for on demand feed into the machining cell.

Figure 3:
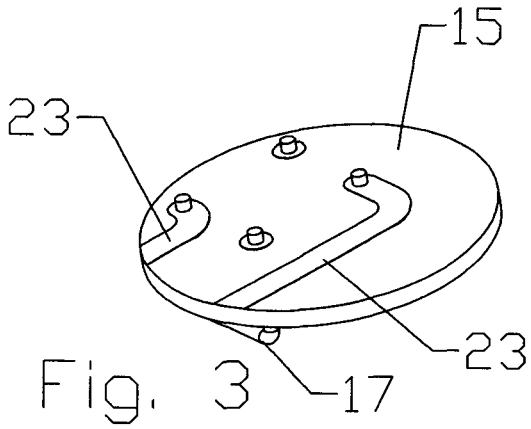
FIG. 3 is a schematic isometric top view of a coupler printed circuit board of the first exemplary embodiment.
Figure 4:
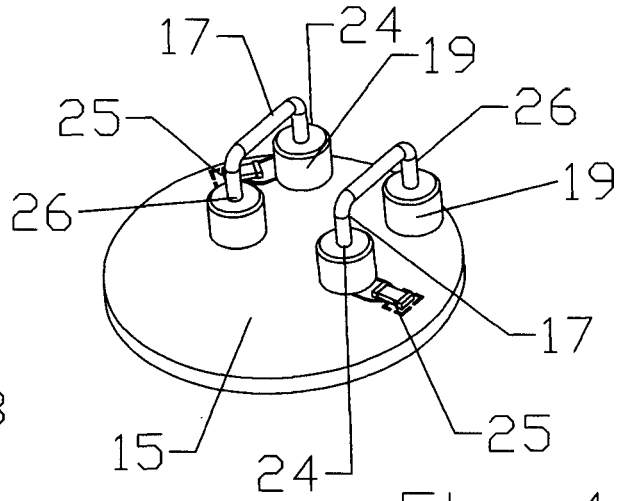
FIG. 4 is a schematic isometric bottom view of a coupler printed circuit board of the first exemplary embodiment.
Figure 5:
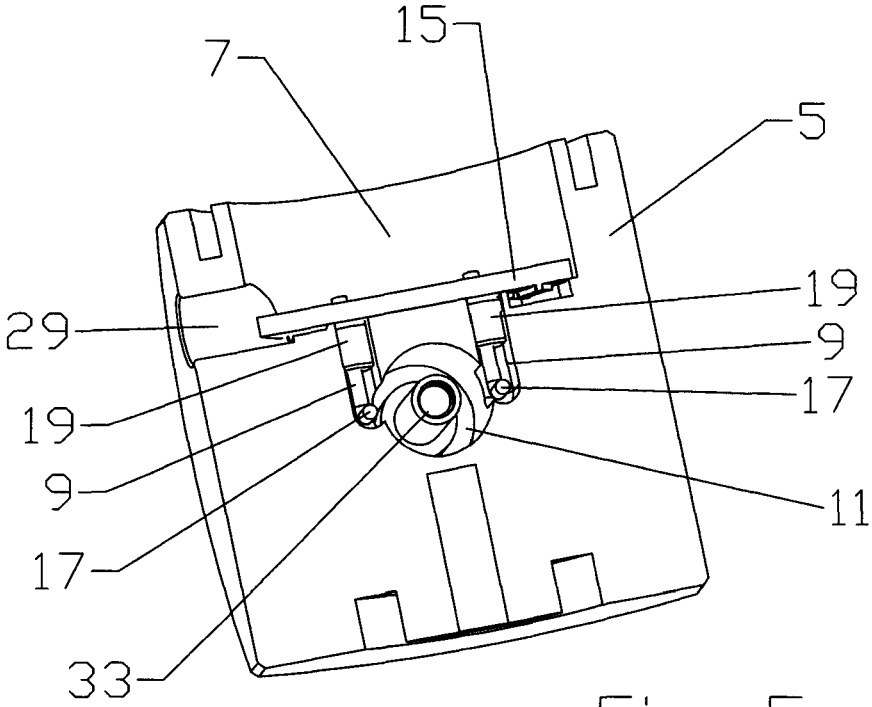
FIG. 5 is a schematic isometric cross-section end view of the body of FIG. 1, with the coupler printed circuit board seated in the coupler PCB chamber of the first exemplary embodiment.

The body 5 is formed with a coupler printed circuit board (PCB) cavity 7 from which at least one coupler slot(s) 9 extends inward, intersecting with the sidewall 8 of a longitudinal bore 11 of the body 5 to form coupler aperture(s) 13 open to the bore 11. As best shown in FIGS. 3 and 4, a coupler PCB 15 is dimensioned for insertion into the coupler PCB cavity 7. The coupler PCB 15 supports coupler(s) 17 arranged spaced apart from one another, parallel to each other (in the present embodiment), in the coupler aperture (s) 13 on either side of the bore 11. In the present embodiment, two generally U-shaped coupler(s) 17 and corresponding coupler aperture(s) 13 are applied so that the coupler(s) 17 are arranged in coupler apertures 13 on opposing sides of the bore 11, at a common longitudinal position, for example as shown in FIG. 5. The coupler(s) 17 may be dimensioned, for example, with a longitudinal dimension that is generally one-quarter of the wavelength of the desired operating frequency band of the directional coupler assembly 1. The coupler(s) 17 are demonstrated with stabilization insulator(s) 19 that may be located on the coupler leg(s), dimensioned to seat within the coupler slot(s) 9, that assist with aligning the coupler leg(s) in a desired orientation, for example normal to the plane of the coupler PCB 15 and that also assist with rotational alignment of the coupler PCB 15 with respect to the coupler slot(s) 9. A first side 24, here a terminated side, of each coupler 17 is coupled either directly or via a trace 23 to an electrical component such as an impedance matching termination load 25 that is further electrically coupled to the body 5. The terminating load 25 may be a surface mount resistor or the like. A second side 26, here a signal side, of each coupler 17 is connected via a respective trace 23 to a junction 27, for example at the coupler PCB 15 periphery for connection to coupler port(s) 29 formed extending from the body 5 periphery into the coupler PCB cavity 7.

Figure 6:
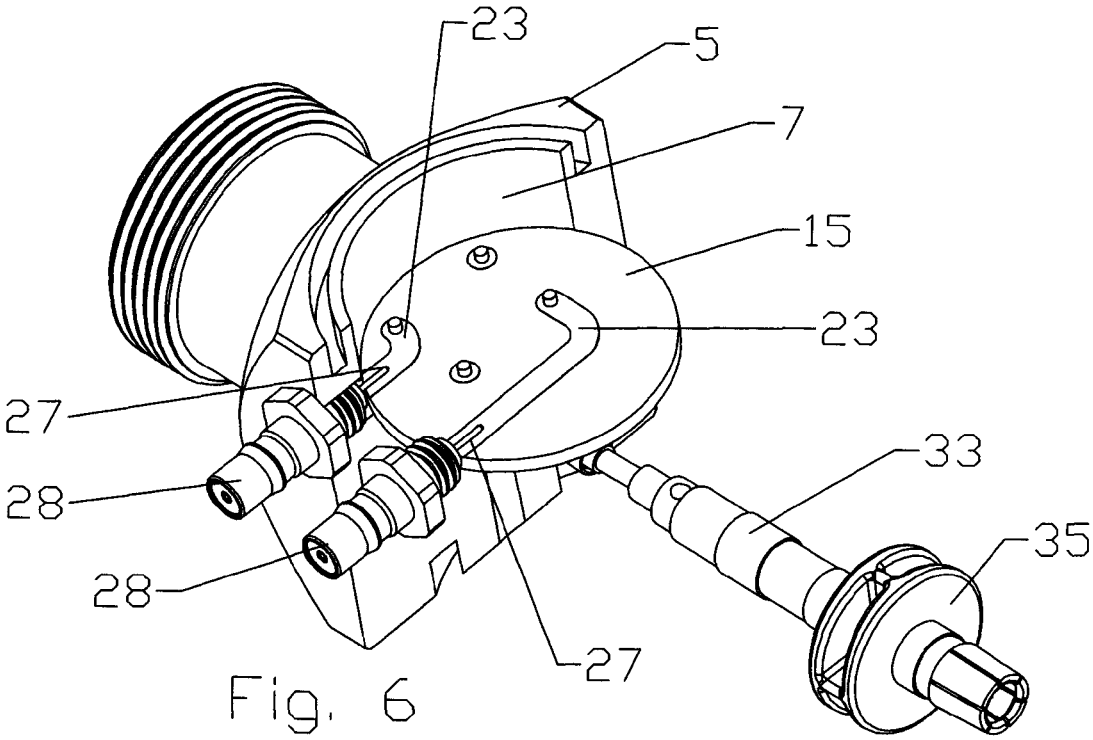
FIG. 6 is a schematic isometric partial cross-section angled top view of the first exemplary embodiment.
Figure 7:
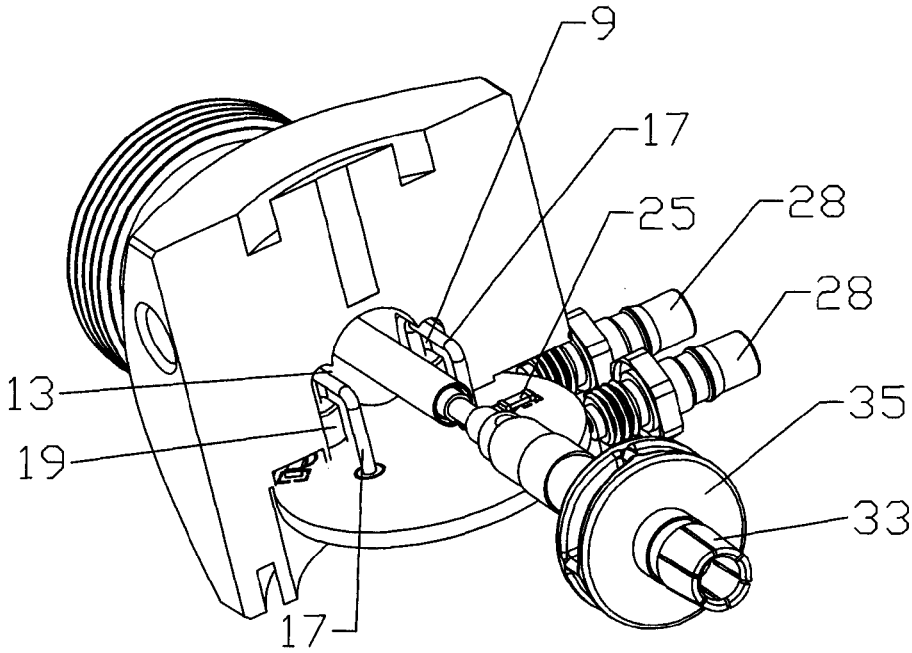
FIG. 7 is a schematic isometric partial cross-section angled bottom view of the first exemplary embodiment.
Figure 8:
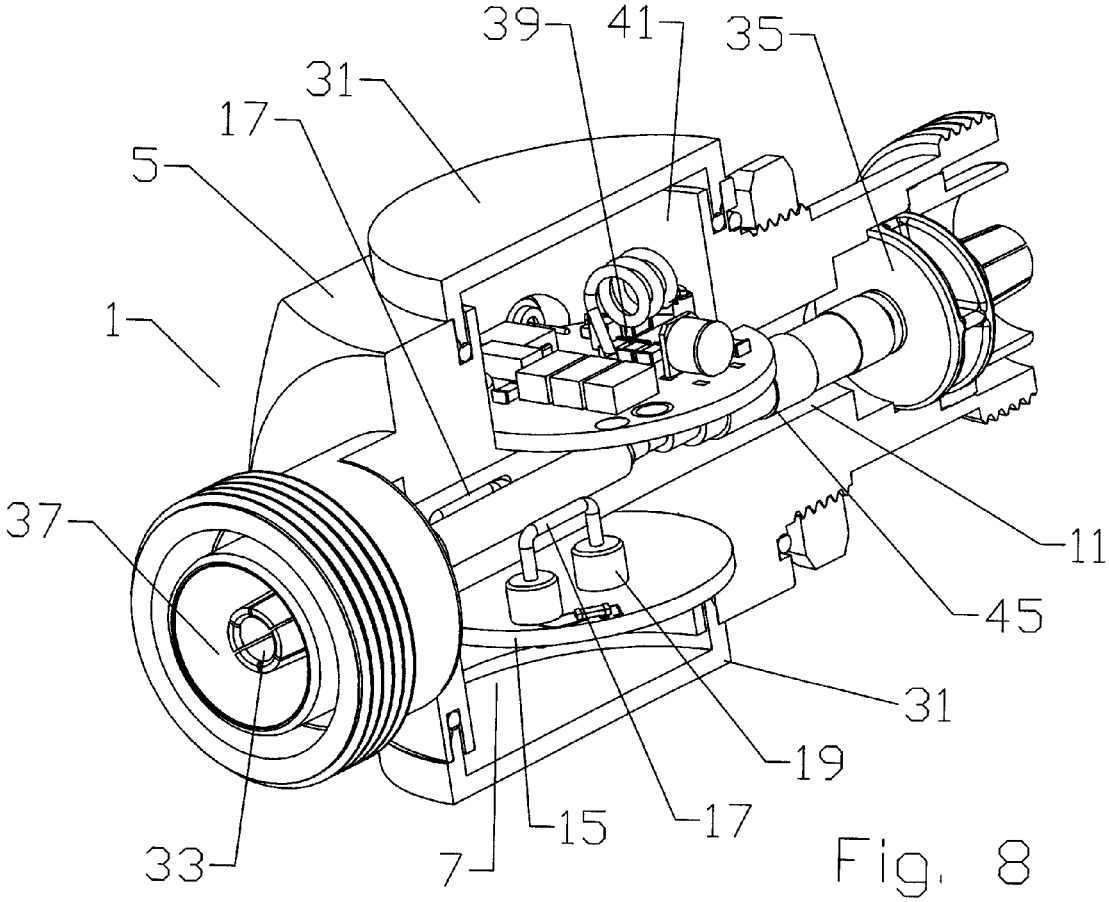
FIG. 8 is a schematic isometric partial cross-section side view of the first exemplary embodiment.

As best shown in FIGS. 6 and 7, coupler connection interface(s) 28, such as coaxial connector connections, are seated in the coupler port(s) 29 aligned for connection to the respective junction(s) 27, for example by a relatively low precision soldering operation. A cover 31 (see FIG. 8) may be dimensioned for sealing attachment to close the coupler PCB cavity 7 via, for example, threads, interference fit, interlocking tab/slot connection or the like.

An inner conductor 33 is supported within and coaxial to the bore 11, for example by a pair of insulators 35. The inner conductor 33 may be formed with various diameter steps and/or ramps as a means for tuning the impedance matching and frequency response characteristics of the coupler assembly 1. At each end of the bore 11 a standardized or proprietary coaxial cable or connector connection interface 37 may be applied.

Figure 16:
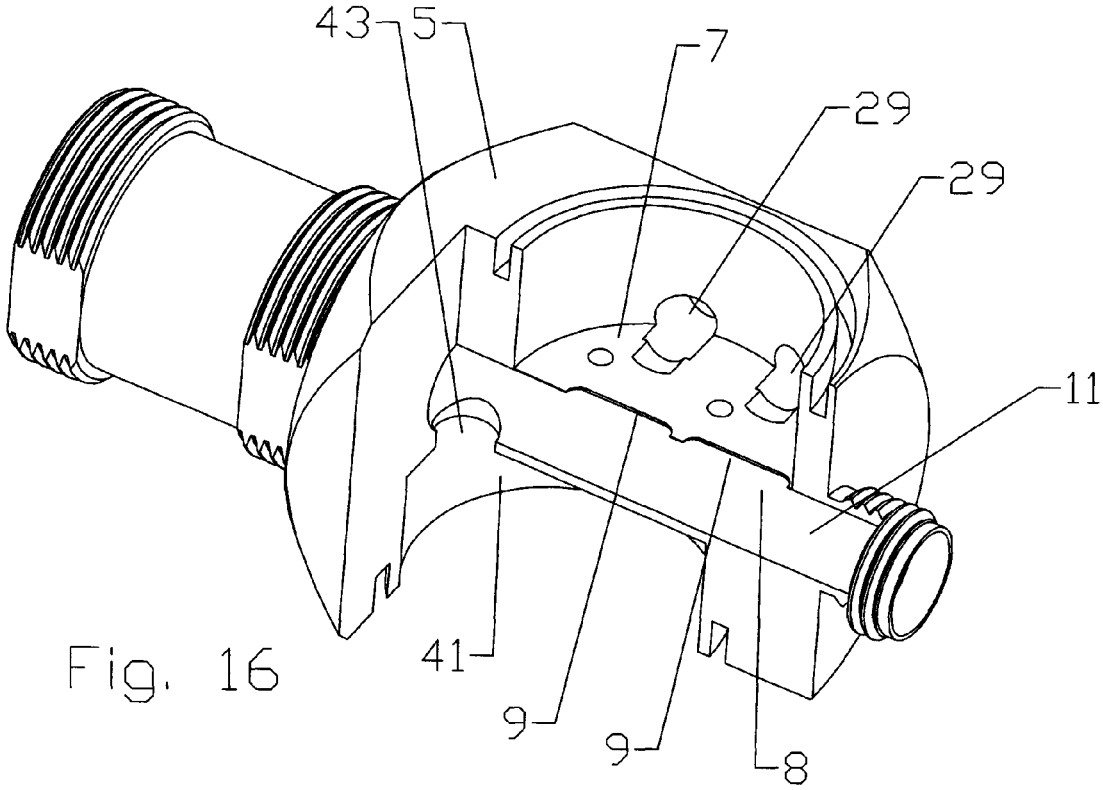
FIG. 16 is a schematic isometric partial cross-section side view of a monolithic body of the third exemplary embodiment.
Figure 17:
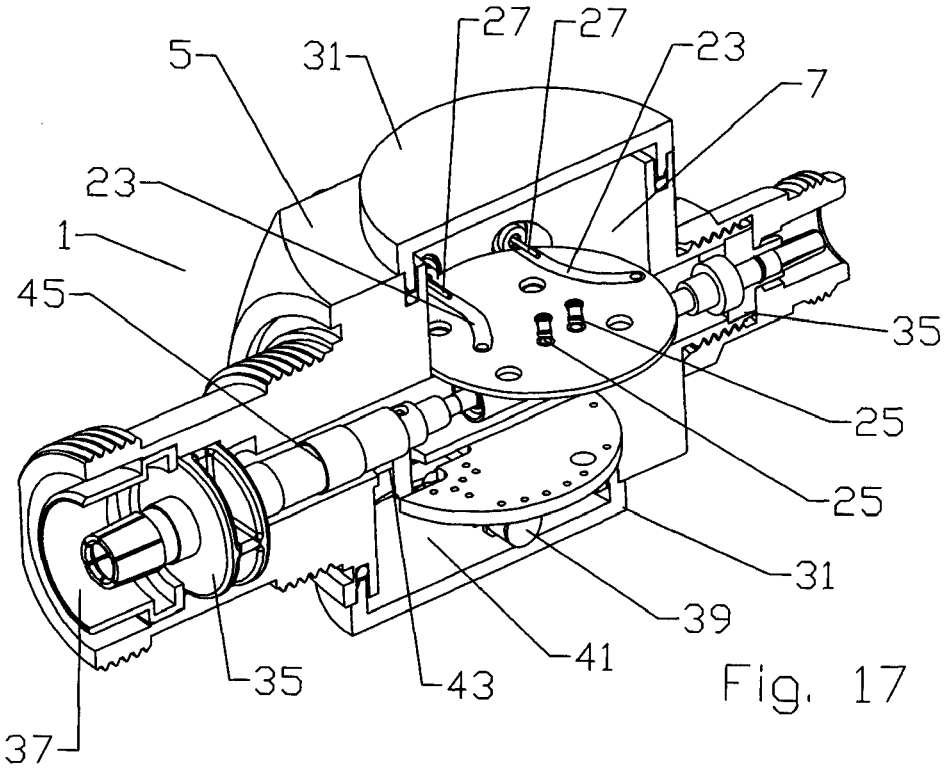
FIG. 17 is a schematic isometric partial cross-section side view of the coupler assembly third exemplary embodiment.
Figure 18:
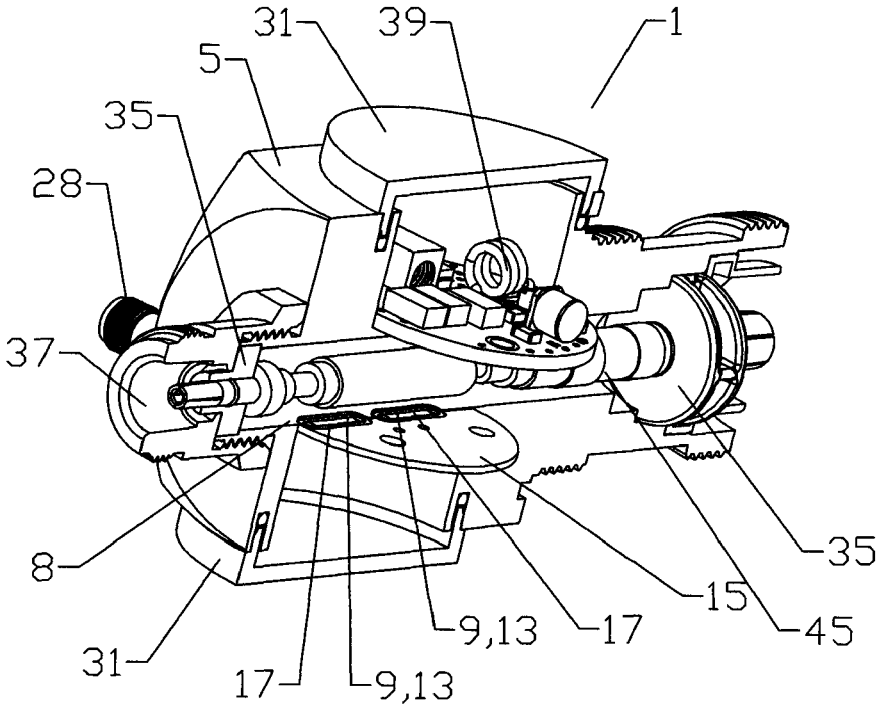
FIG. 18 is a schematic isometric partial cross-section side, reverse angle, view of FIG. 17.
Figure 19:
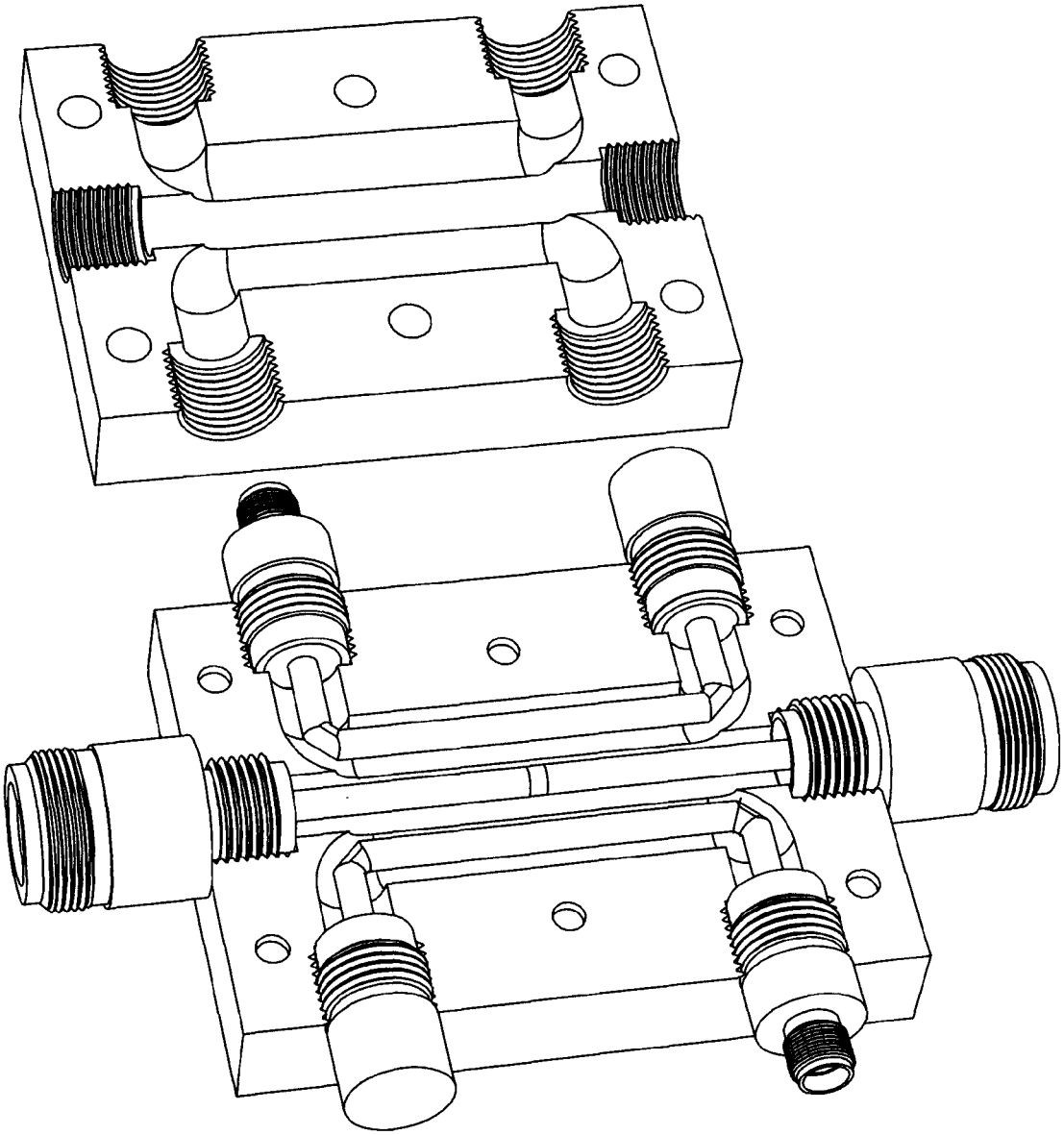
Prior Art Fig. 19
FIG. 19 is a schematic isometric exterior view of a typical prior art two-part body directional coupler, the body open.
Figure 20:
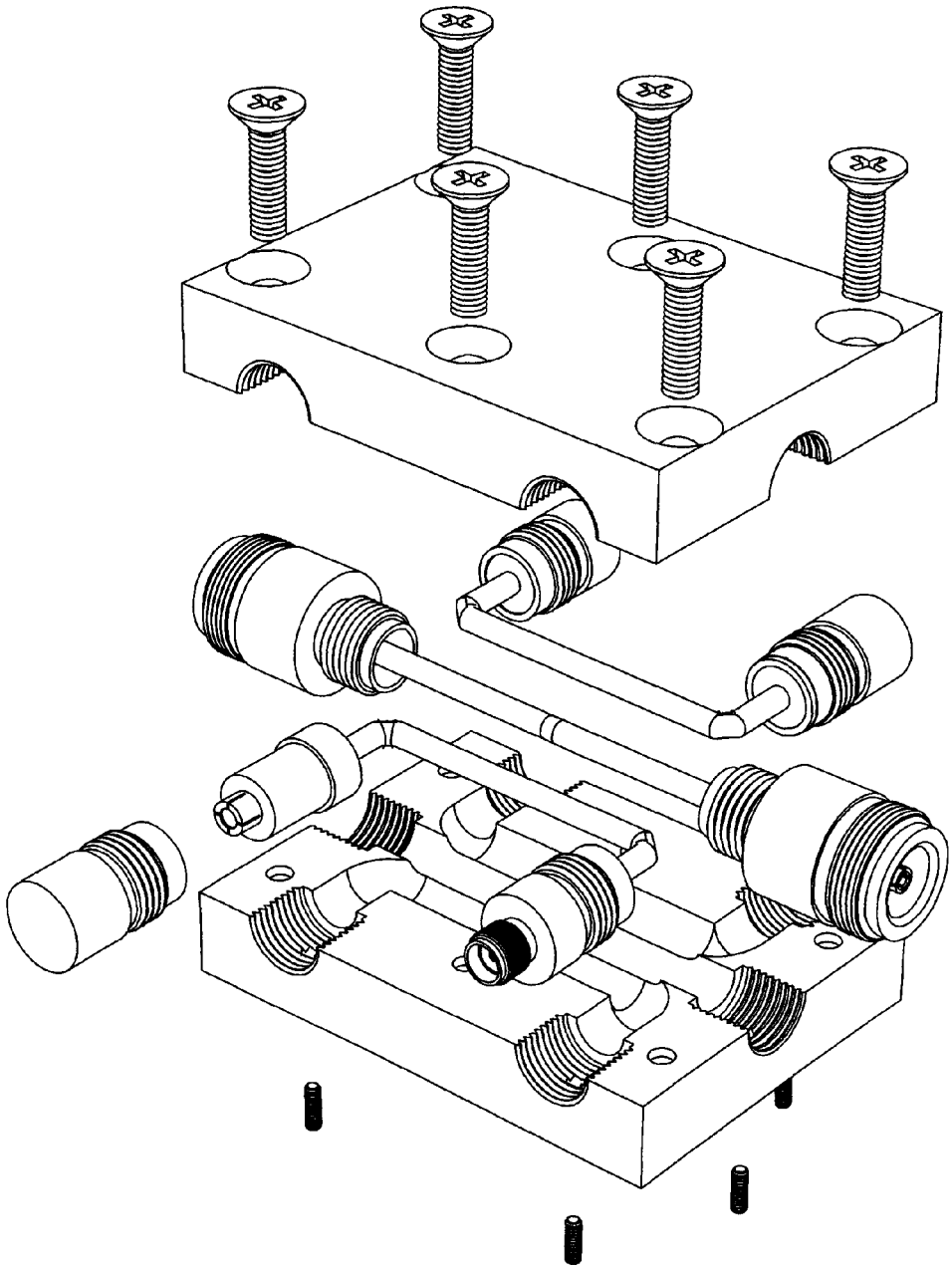
Prior Art Fig. 20
FIG. 20 is a schematic isometric exploded view of the prior art directional coupler of FIG. 19.

The compact form of the coupler assembly 1 according to the invention enables cost effective integration of additional functionality into a single assembly. For example, as demonstrated in FIG. 8, a DC bias circuit 39 may be incorporated into a bias PCB chamber 41 formed in the body 5 on a side opposite of the coupler PCB cavity 7, also closed by a cover 31. DC bias circuit(s) 39 are known in the art and as such are not further described herein. The DC bias circuit 39 is coupled to the inner conductor 33 via a bias aperture 43 (see FIGS. 16 and 17). A DC break 45, wherein a dielectric spacer, sleeve or other direct conductive break may be inserted in-line between, for example, parallel plates or between a pin into socket connection along the inner conductor 33, may be applied if the voltage applied by the DC bias circuit 39 is only desired at one end of an attached coaxial signal line, for example to energize and/or control circuitry at a remote antenna.

Figure 9:
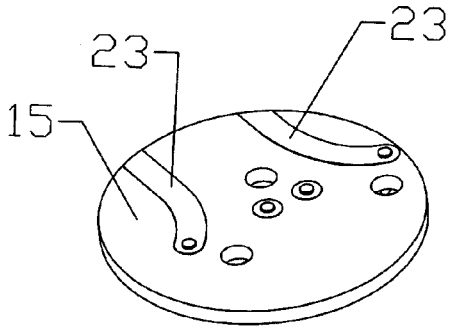
FIG. 9. is a schematic isometric top view of a coupler printed circuit board of a second exemplary embodiment.
Figure 10:
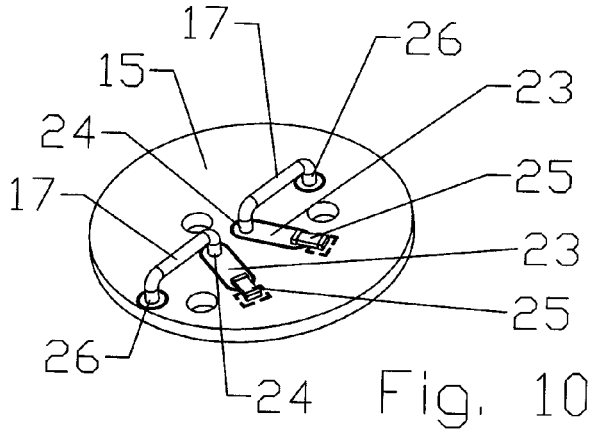
FIG. 10 is a schematic isometric bottom view of the coupler printed circuit board of FIG. 9.
Figure 11:
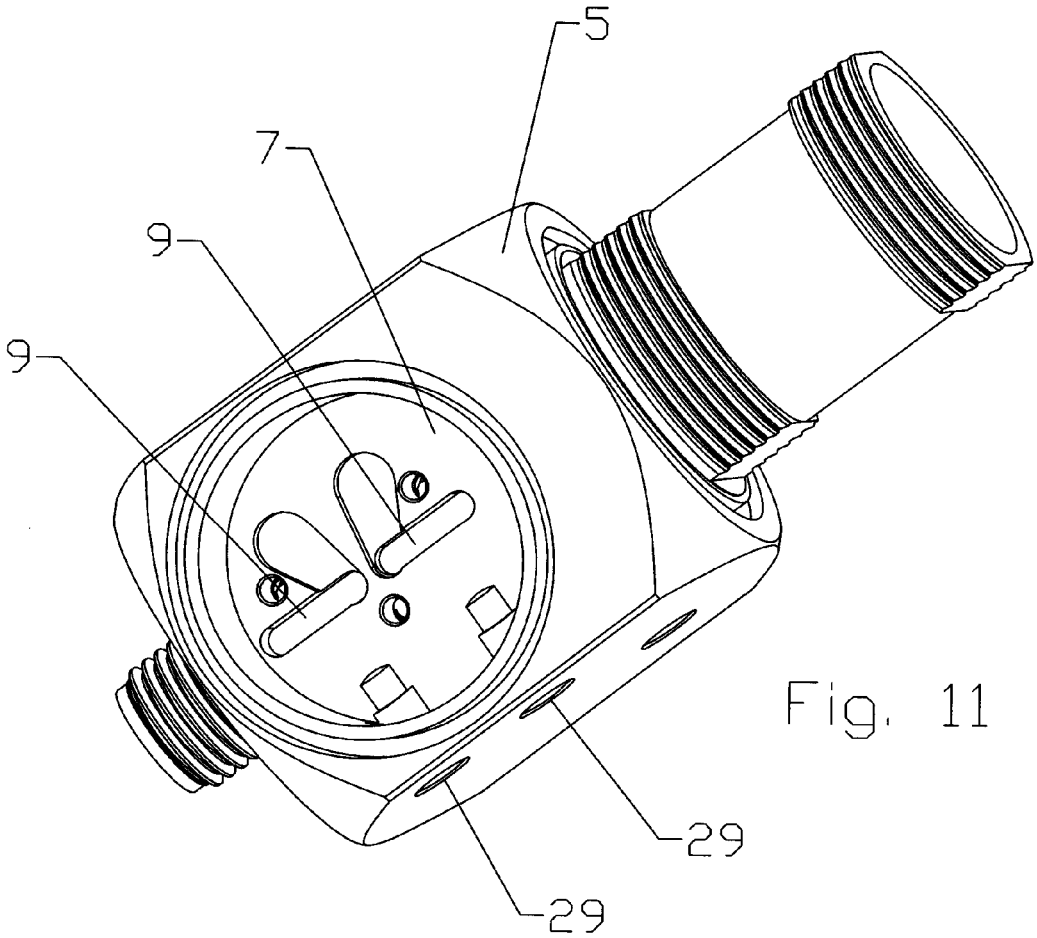
FIG. 11 is a schematic isometric top view of a monolithic body of the second exemplary embodiment.
Figure 12:
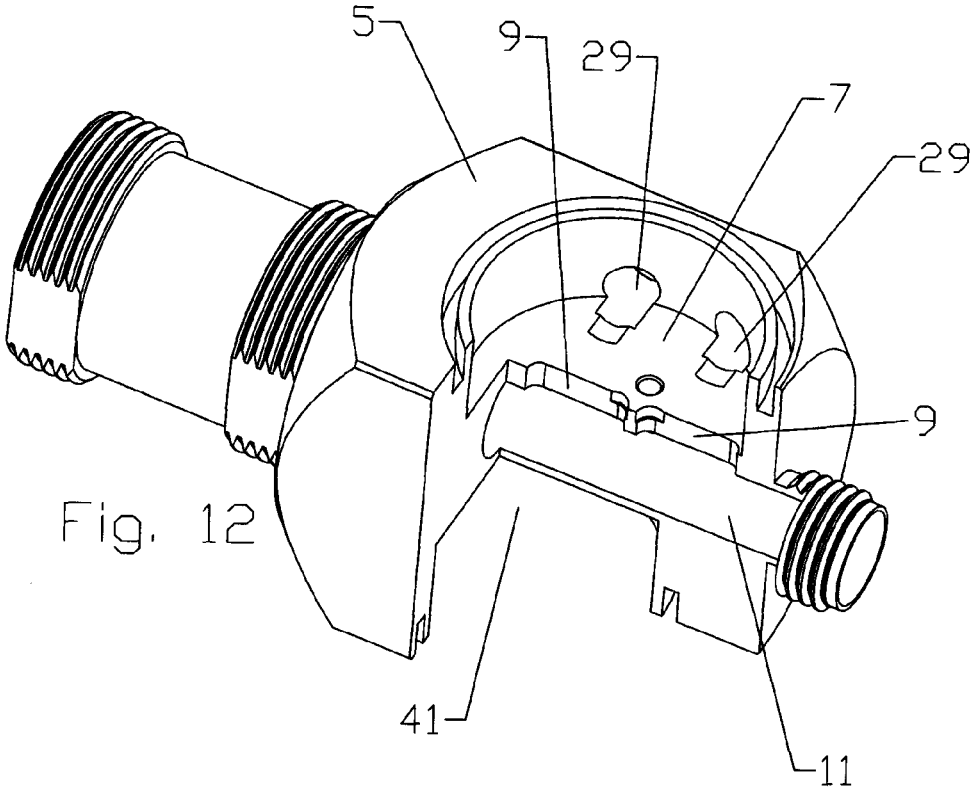
FIG. 12 is a schematic isometric partial cross-section side view of the monolithic body of the second exemplary embodiment.
Figure 13:
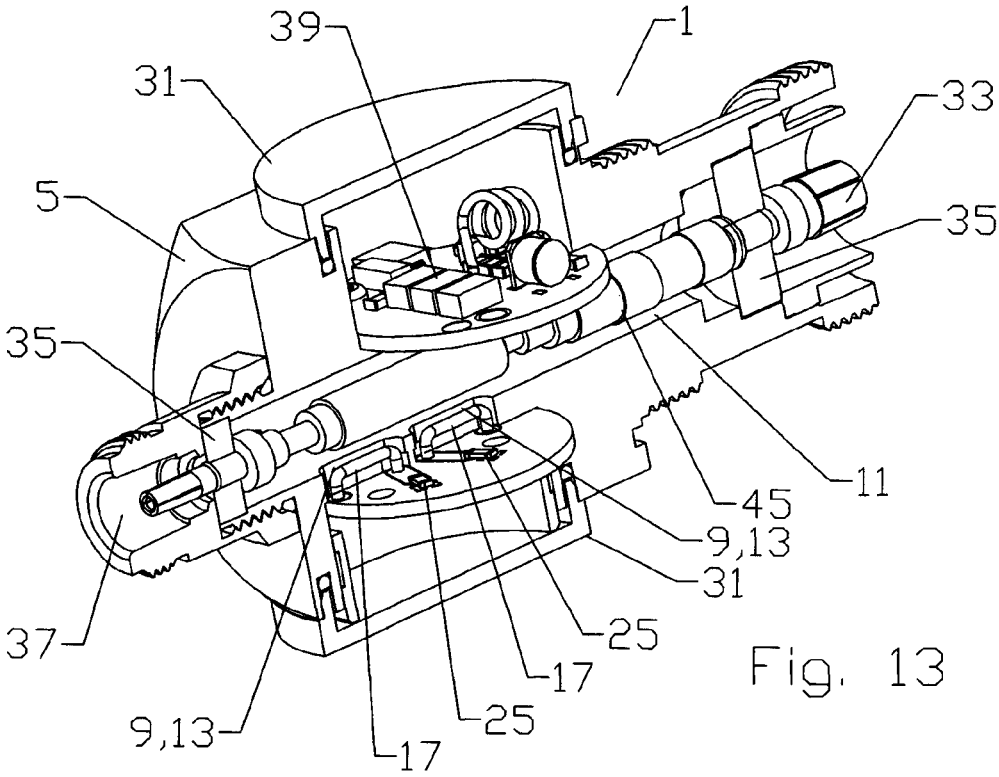
FIG. 13 is a schematic isometric partial cross-section side view of the coupler assembly second exemplary embodiment.
Figure 14:
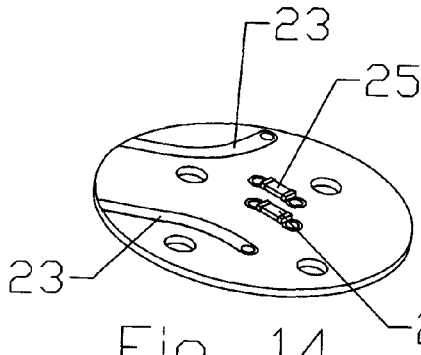
FIG. 14 is a schematic isometric top view of a coupler printed circuit board of a third exemplary embodiment.
Figure 15:
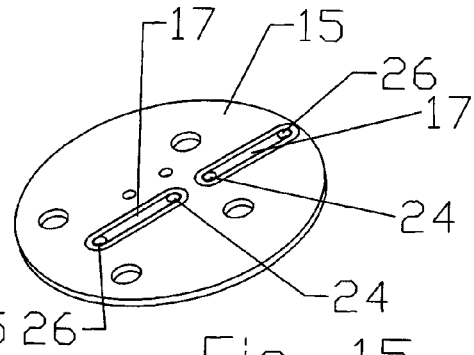
FIG. 15 is a schematic isometric bottom view of the coupler printed circuit board of FIG. 14.

In alternative embodiments, the couplers and corresponding coupler slots may be arranged in a range of alternative configurations. For example, as shown in FIGS. 9-13, the couplers may be applied in-line with each other, in a single extended or individual coupler slot(s) 9. This configuration has the advantage of simplified machining and also demonstrates trace(s) 23 of the coupler PCB arranged with equal lengths for example to maintain each of the split signals with a common phase (see FIG. 8). The PCB of FIG. 9 is demonstrated with a dual directional configuration, where each of the coupler(s) 17 is terminated in a separate direction; that is, the terminated sides of the two coupler(s) 17 are on opposite sides of the respective coupler(s) 17 with respect to the longitudinal axis of the bore. Alternatively, the coupler(s) 17 may be terminated in a common direction, for example where dual low power signal splits isolated from one another are desired.

In further embodiments, for example as shown in FIGS. 14-18, one skilled in the art will appreciate that the coupler(s) 17 may themselves be formed as trace(s) 23 on the coupler PCB 15, the coupler PCB chamber 7 extended towards the bore 11 to form the coupler aperture 13 with minimal or no coupler slot 9 depth between the PCB chamber and the bore, such that the coupler trace(s) on the surface of the coupler PCB 15 are presented in the coupler slot(s) 17 directly to the bore 11 i.e., there is a generally tangential intersection between a floor of the coupler PCB chamber 7 and the bore 11.

The present invention may be similarly applied to transmission line configurations other than coaxial. For example, the inner conductor 33 may be omitted and the bore 11 formed complementary to a desired waveguide cross section.

One skilled in the art will appreciate that in each embodiment the monolithic body 5 of a coupler assembly 1 according to the invention may present a significant savings in manufacturing costs by reducing the overall size and eliminating the prior requirement for multiple machining set-up operations. Further, environmental sealing issues associated with the prior two half arrangements may be eliminated and the overall number of components may be significantly reduced. The coupler PCB 15 mounting of the coupler(s) 17 and/or formation of the of the coupler(s) 17 as traces of the coupler PCB 15 traces may greatly simplify quality control problems and may further reduce the skilled labor requirements necessary to assemble the directional coupler. Finally, because the directional coupler body 5 is unitary, the directional coupler assembly 1 may have improved vibration and shock resistance characteristics.

Table of Parts

| | |
|---|---|
| 1 | directional coupler assembly |
| 5 | body |
| 7 | coupler PCB chamber |
| 8 | sidewall |
| 9 | coupler slot |
| 11 | bore |
| 13 | coupler aperture |
| 15 | coupler PCB |
| 17 | coupler |
| 19 | stabilization insulator |
| 23 | trace |
| 24 | first side |
| 25 | termination load |
| 26 | second side |
| 27 | junction |
| 28 | connection interface |
| 29 | coupler port |
| 31 | cover |
| 33 | inner conductor |
| 35 | insulator |
| 37 | connector connection interface |
| 39 | DC bias circuit |
| 41 | bias chamber |
| 43 | bias aperture |
| 45 | DC break |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

The invention claimed is:

1. A coupler assembly, comprising:

a monolithic body with a bore along a longitudinal axis;

a coupler PCB chamber with at least one coupler slot(s) communicating between the PCB chamber and the bore;

a coupler printed circuit board seated in the coupler PCB chamber;

at least two couplers, the couplers mounted upon the printed circuit board aligned substantially parallel with the at least one coupler slot(s);

a first side of each coupler coupled to a terminating load; and a second side of each coupler coupled to a connection interface.

2. The coupler assembly of claim 1, wherein the couplers each extend within a respective one of the coupler slot(s), towards the bore; the coupler slots each positioned on an opposing side of the bore.

3. The coupler assembly of claim 2, further including stabilization insulator(s) on each of the couplers supporting each coupler within its respective coupler slot.

4. The coupler assembly of claim 2, wherein each of the couplers has a generally U shape.

5. The coupler assembly of claim 1, further including a bias chamber in the body; a DC bias circuit seated within the bias chamber; the DC bias circuit coupled to an inner conductor within the bore via a bias aperture communicating between the bore and the bias chamber.

6. The coupler assembly of claim 5, wherein the bias chamber and the coupler PCB chamber are formed in opposite sides of the body.

7. The coupler assembly of claim 1, wherein the couplers are aligned end to end, parallel to the longitudinal axis.

8. The coupler assembly of claim 7, wherein the couplers each extend within a respective one of the coupler slot(s), towards the bore.

9. The coupler assembly of claim 1, wherein the coupling between the second side of each coupler and the connection interface is via a trace on the coupler printed circuit board; each of the traces having a substantially equal length.

10. The coupler assembly of claim 1, wherein the coupler PCB chamber tangentially intersects with the bore at the coupler slot(s).

11. The coupler assembly of claim 1, wherein the couplers are traces on the coupler printed circuit board.

12. The coupler assembly of claim 11, wherein the traces of the couplers and traces coupling the second side of the couplers to the connection interface(s) are located on opposite sides of the coupler printed circuit board.

13. The coupler assembly of claim 1, wherein the terminating load is a surface mount resistor on the coupler printed circuit board.

14. A coupler assembly, comprising:

a monolithic body with a bore along a longitudinal axis;

a coupler PCB chamber with at least one coupler slot(s) communicating between the PCB chamber and the bore;

a coupler printed circuit board seated in the coupler PCB chamber;

at least two couplers, the couplers mounted upon the printed circuit board aligned substantially parallel with the at least one coupler slot(s); the couplers each extending within a respective one of the coupler slot(s), towards the bore;

a first side of each coupler coupled to a terminating load; and a second side of each coupler coupled to a connection interface; and a bias chamber in the body; a DC bias circuit seated within the bias chamber; the DC bias circuit coupled to an inner conductor within the bore via a bias aperture communicating between the bore and the bias chamber;

the bias chamber and the coupler PCB chamber are formed in opposite sides of the body;

the coupling between the second side of each coupler and the connection interface is via a trace on the coupler printed circuit board; each of the traces having a substantially equal length.

15. The coupler assembly of claim 14, wherein the couplers are aligned end to end, parallel to the longitudinal axis.

16. The coupler assembly of claim 14, wherein the couplers each extend within a respective one of the coupler slot(s), towards the bore; the coupler slots each positioned on an opposing side of the bore.

17. The coupler assembly of claim 14, wherein the couplers are traces on the coupler printed circuit board.

18. The coupler assembly of claim 17, wherein the traces of the couplers and traces coupling the second side of the couplers to the connection interface(s) are located on opposite sides of the coupler printed circuit board.

19. A method for manufacturing a coupler assembly, comprising the steps of:

forming a monolithic body with a bore along a longitudinal axis;

forming a coupler PCB chamber in the body with at least one coupler slot(s) communicating between the PCB chamber and the bore; and seating a coupler printed circuit board with at least two couplers into the coupler PCB chamber, the couplers mounted upon the printed circuit board aligned substantially parallel with the at least one coupler slot(s), a first side of each coupler coupled to a terminating load and a second side of each coupler coupled to a connection interface.

20. The method of claim 19, further including the step of forming a bias chamber in the body; and seating a DC bias circuit within the bias chamber; the DC bias circuit coupled to an inner conductor positioned within the bore through a bias aperture communicating between the bore and the bias chamber.

* * * * *